US011492907B2

(12) United States Patent
Sbarounis

(10) Patent No.: US 11,492,907 B2
(45) Date of Patent: Nov. 8, 2022

(54) CARTIODAL ROTARY MACHINE WITH TWO-LOBE ROTOR

(71) Applicant: Joseph A. Sbarounis, Dayton, OH (US)

(72) Inventor: Joseph A. Sbarounis, Dayton, OH (US)

( * ) Notice: Subject to any disclaimer, the term of this patent is extended or adjusted under 35 U.S.C. 154(b) by 0 days.

(21) Appl. No.: 17/088,631

(22) Filed: Nov. 4, 2020

(65) Prior Publication Data

US 2022/0136392 A1 May 5, 2022

(51) Int. Cl.

| | |
|---|---|
| ***F01C 1/22*** | (2006.01) |
| ***F01C 21/08*** | (2006.01) |
| ***F01C 1/10*** | (2006.01) |
| ***F01C 17/02*** | (2006.01) |

(52) U.S. Cl.

CPC ..... *F01C 1/22* (2013.01); *F01C 1/104* (2013.01); *F01C 17/02* (2013.01); *F01C 21/089* (2013.01)

(58) Field of Classification Search

CPC .. F01C 1/22; F01C 1/104; F01C 17/02; F01C 21/089

USPC ..... 418/191, 61.2, 54, 125, 248, 60

See application file for complete search history.

(56) References Cited

U.S. PATENT DOCUMENTS

| | | | | | |
|---|---|---|---|---|---|
| 3,322,103 | A * | 5/1967 | Dirnberger | F02B 53/00 | 418/161 |
| 3,799,126 | A * | 3/1974 | Park | F01C 1/28 | 418/196 |
| 3,858,557 | A * | 1/1975 | Myers | F02B 53/08 | 123/213 |
| 3,877,442 | A * | 4/1975 | Miller, Jr. | F01C 1/3445 | 418/169 |
| 4,083,663 | A * | 4/1978 | Montalvo | F01C 1/36 | 418/183 |
| 4,300,874 | A * | 11/1981 | Georgiev | F01C 1/22 | 418/150 |
| 4,373,484 | A * | 2/1983 | Boehling | F01C 1/28 | 418/196 |
| 5,259,739 | A * | 11/1993 | Coates | F01C 1/22 | 418/1 |
| 5,393,208 | A * | 2/1995 | Sbarounis | F01C 1/22 | 418/54 |
| 7,264,452 | B2 | 9/2007 | Sbarounis | | |

FOREIGN PATENT DOCUMENTS

| | | | | |
|---|---|---|---|---|
| GB | 1499855 | A * | 2/1978 | F02B 53/10 |

* cited by examiner

*Primary Examiner* — J. Todd Newton
(74) *Attorney, Agent, or Firm* — R. William Graham

(57) ABSTRACT

Two rotors with two lobes are eccentrically mounted within the chamber of a two-lobe rotary machine. The rotors have a periphery defined by a the path of the opposing rotor apex.

8 Claims, 20 Drawing Sheets

Exploded View 1

Exploded View 1

Exploded View 2

Exploded View 3

CARTIODAL ROTARY MACHINE WITH TWO-LOBE ROTOR

BACKGROUND OF THE INVENTION

1. Field of the Invention

The present invention relates to the two-lobe rotary machine. More particularly, the present invention relates to the use of two or more eccentrically mounted two-lobe rotors controlled by a rotor positioning mechanism. The rotor apexes isolate the working volumes of the machine by interacting with the periphery of the opposing rotor and the inner surface of the (outer housing) and an inner sealing member. The advantages are a balanced assembly, a more constant flow through the machine, more cycles for a given rotation of the shaft, and improved startup torque and torque output when powered by a flow of liquid or gas.

2. Description of Related Art

The two-lobe rotary machine consists of a lenticular rotor eccentrically mounted within a cartiodal chamber. These are often referred to as Wankel type machines but actually predate Wankel by many decades. The stroke of these machines may be made longer relative to the distance between apexes in attempts to increase power or attempting to achieve other benefits.

The internal gear positioning mechanism allows for a stroke that can be reduced only to an amount allowed for by the internal gear fitting within the rotor periphery. Positioning mechanisms of other types that are more compact than the internal gear allowed for a longer stroke, but this still had limitations if the crank was to be contained within the rotor periphery.

In prior art, it has been described that the stroke could be increased further by locating the positioning mechanism outside of the sidewalls of the chamber and using a shaft sidewall that is integral with the crank web to seal the chamber. This allows the distance between the apexes to be reduced to twice the stroke. Beyond this, the rotor tips will come out of contact with the housing at the center of the least volume portion of the working volume. The rotor at this point will also not clear the protrusion at the least volume portion.

A vane radially displaced adjusting to the surface of the rotor can allow for a smaller rotor still by moving inward to seal against the rotor tip as it passes over the protrusion, and outward to allow clearance of the rotor periphery. These machines can be made very long relative to the rotor apex distance and are very rigid with a positioning mechanism on either side of the rotor.

The reversing gear mechanism is small enough relative to the rotor size to make this practical. The rotor can be spun up to high speeds and shaped to move air to produce thrust or catch wind to produce power. The radially adjustable vane is then not so important due to aerodynamic effects becoming more significant. The description of the aerodynamic effects for different shape rotors, housing inner wall positions, inlet and outlet flow positions, static thrust versus dynamic thrust, angle of flow, axial vs radial flow, and the cyclic flow make this a very complex topic.

It would be highly desirable for the device to be inherently balanced, have a more continuous flow and torque, and displace greater volume for a given size. This means smooth and balanced operation at very high RPM. Flows on the order of propellers and turbo machinery are ultimately desirable.

SUMMARY OF INVENTION

It is an object of the present invention to provide for an improved two lobe rotary machine for use as a pump or pressure driven device.

Another objective of the invention is to double the compression or power strokes for the rotation of the shaft.

Another objective of the invention is to allow for complete balance using the rotors as counterbalances.

Another objective of the invention is to provide for a rotary machine that produces an improved output through the angles of rotation of the shaft.

Another objective is to provide the use of a longer crank length for a given size rotor or a smaller rotor for a given size crank length.

Another objective of the present invention is to increase the volume that may be displaced as compared to the overall size and mass of the rotary engine.

These and other objects of the present invention will become apparent in the following description. A rotary machine comprising two substantially lenticular two-lobe rotors displaced within a chamber for eccentric rotation. Each of the rotors is rotatably mounted on opposing eccentric crank pins and controlled by a rotor positioning mechanism, such that the lenticular rotors have apexes which remain confined within a common defined orbital pattern. In a first embodiment there is a rotor positioning mechanism on both sides of the rotor that allows the torque to be transmitted through the rotor and power the opposing side or the rotor. This allows very long rotors while keeping the shaft on either side of the rotor in alignment. The rotor positioning mechanism shown uses the reversing gear mounted on the crank web, however, other mechanisms described in prior art such as a timing belt are suitable.

The rotor is slidably mounted between two end walls of two side housings and two shaft side walls of two shaft side housings forming a seal. The two apex are positioned to move in close proximity to the outer housing inner annular wall over a substantial part of the rotation in order to isolate separate volumes within the chamber.

The lenticular rotors have a periphery contained within a maximum envelope defined by the movement of the apexes of the opposing rotors. The two rotors can be diametrically opposing at the same crank length, or the rotors could be at different crank lengths and displaced at angles other than 180 degrees.

The second embodiment of the present invention has rotors that are more blade like and cooperate with a sealing member protruding from a second side housing, said sealing member having surface shaped to be in close proximity with rotor surface and alternatively rotor apieces.

A third embodiment of the present invention has a sealing member supported by a stationary side seal attached to a shaft extending inward from central gears mounted in side housings on each side of the rotor. This has the advantages achieved with the first embodiment of allowing the use of long rotors and maintaining alignment of crank webs by transferring torque through the rotors.

A fourth embodiment of the present member has three rotors and central seal portion shaped to allow additional induction and compression with centrifugal forces similar to the radial flow turbine.

BRIEF DESCRIPTION OF THE DRAWINGS

FIG. 10 is an illustration of the rotors relative apex and stroke for elements in

FIG. 6;

DETAILED DESCRIPTION OF THE PREFERRED EMBODIMENTS

Figure 17:
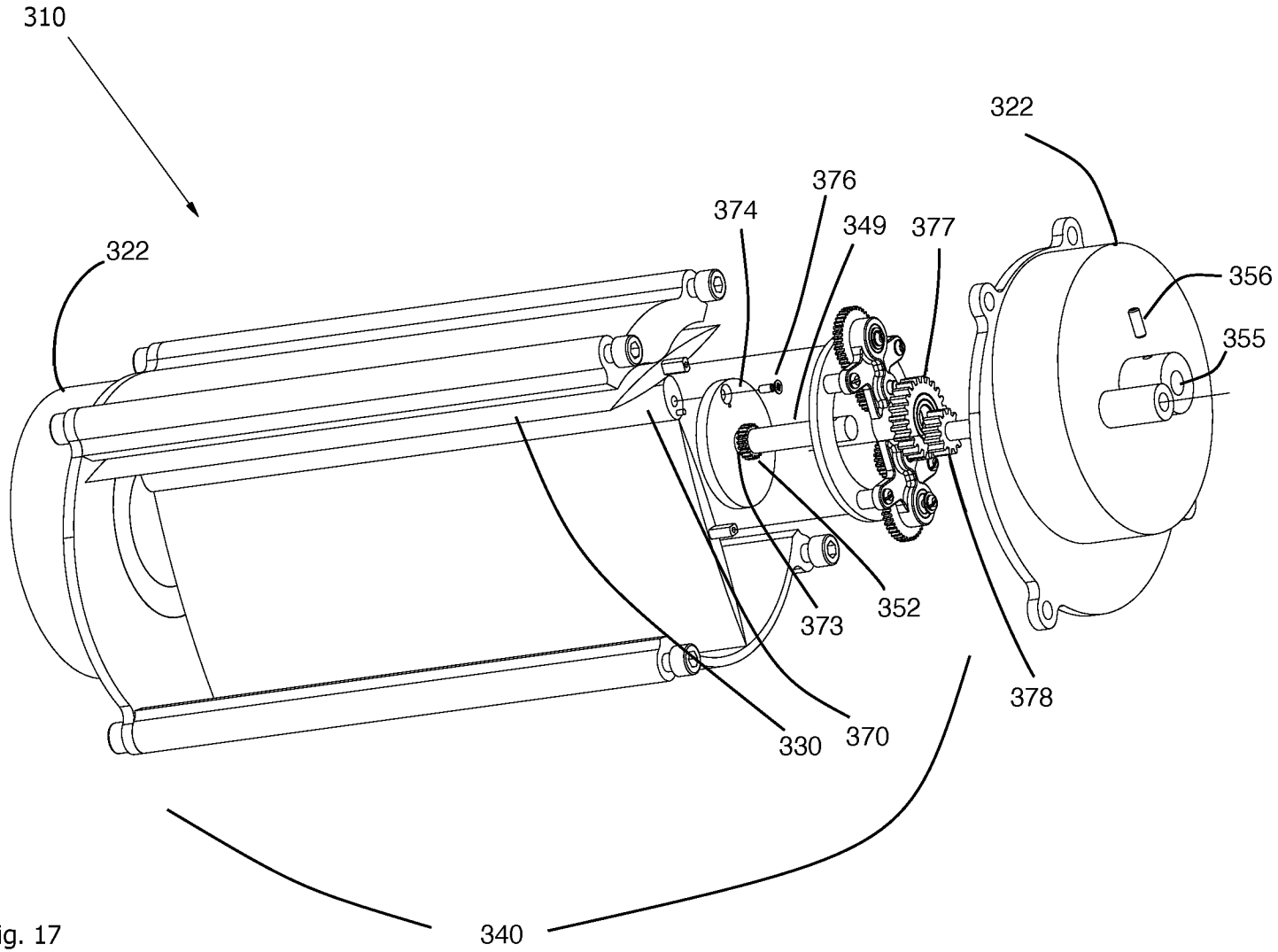
FIG. 17 is a perspective partially exploded view of a third embodiment of a rotary machine having an internal sealing member and a positioning mechanism on both sides of the rotor according to principles of the present invention.
Figure 18:
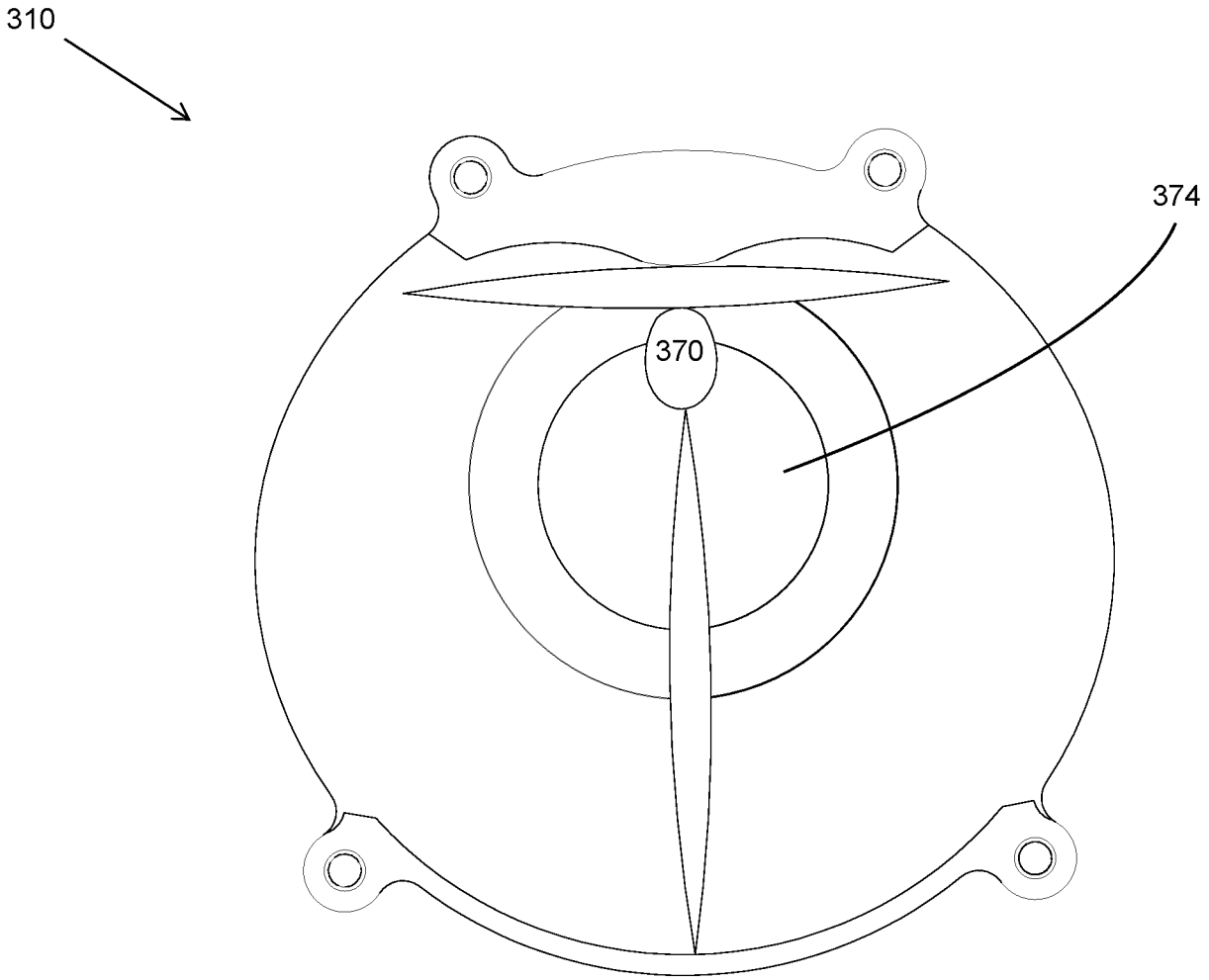
FIG. 18 is a cutaway plan end view of certain elements of the rotary machine of FIG. 17 in a first rotational phase illustrating a top dead center position.
Figure 19:
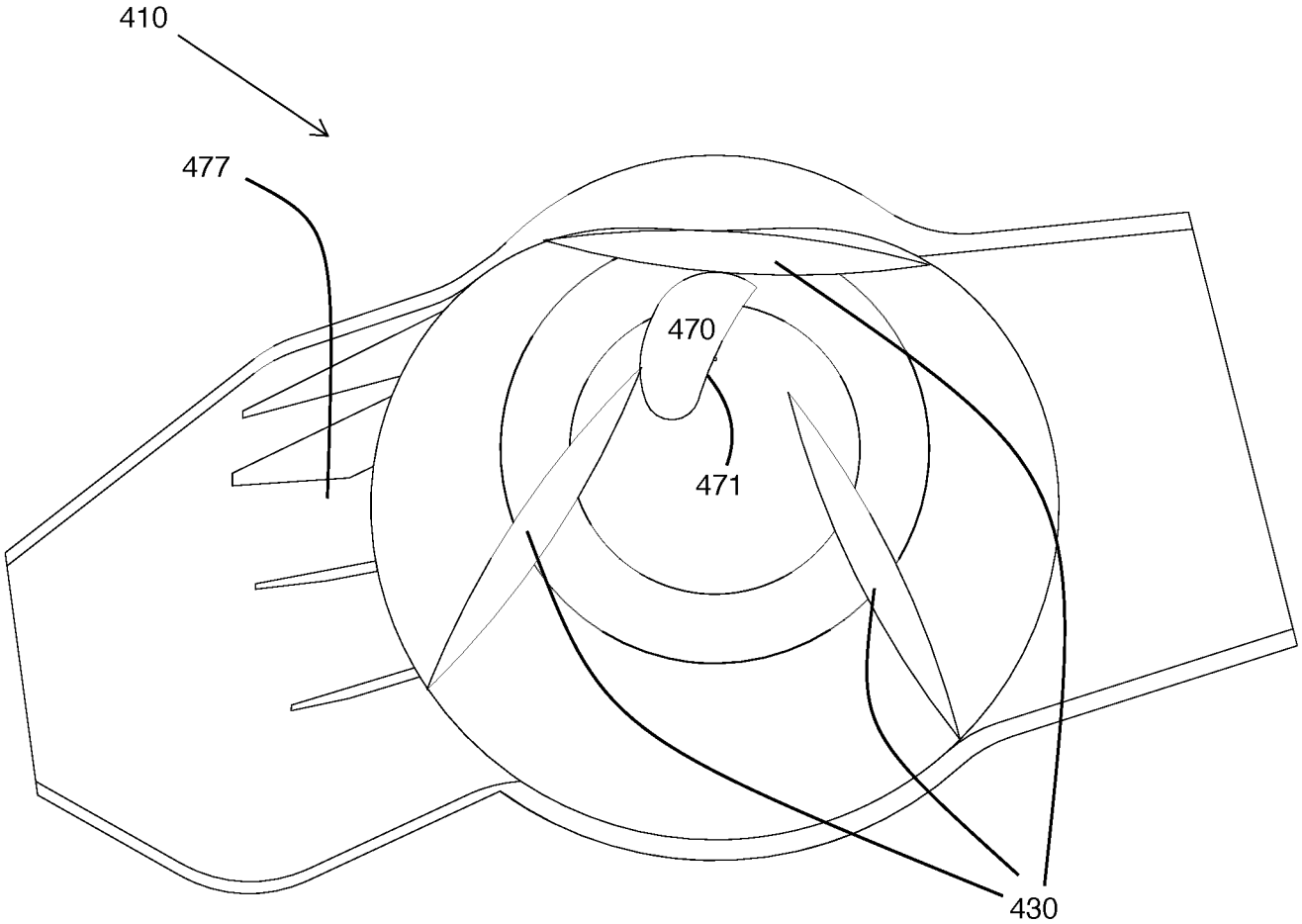
FIG. 19 is a cutaway plan end view of certain elements of a fourth embodiment of a rotary machine with three rotors in a first rotational phase illustrating a top dead center position.
Figure 20:
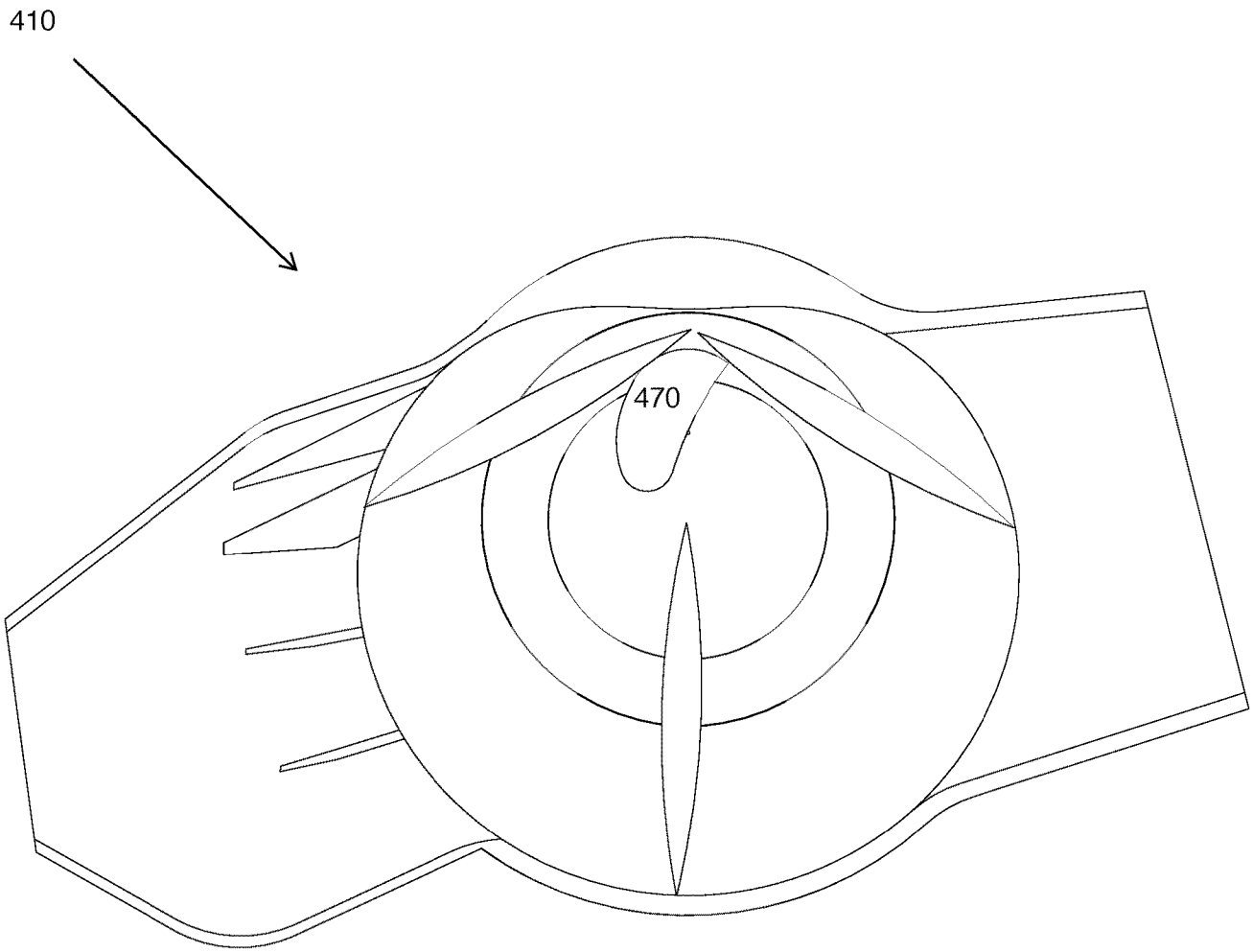
FIG. 20 is a cutaway plan end view of certain elements of the rotary machine of FIG. 19 in a second rotational phase.

Referring now to the drawings, the rotary machine of the invention is generally designated by the numerals 110, 210, 310, and 410. Like numerals refer to like parts. FIG. 1 through FIG. 8 depict a first embodiment of the present invention. FIG. 9 through FIG. 12 describe rotor outer envelope geometry constraints. FIG. 13 through FIG. 16 depict a second embodiment of the present invention allowing for an additional sealing member 270 extending from second side housing inwardly facing wall 223. FIG. 17 and FIG. 18 depict a third embodiment of the present invention having the internal sealing element supported on sides of the rotor with rotor positioning mechanisms. FIG. 19 and FIG. 20 depict a fourth embodiment of the present invention with three rotors and a central sealing member shaped to allow induction ad compression of inlet gases.

Referring now to FIGS. 1-8, a first embodiment of a rotary machine 110 according to principals of the present invention includes an outer housing 116 having inwardly facing annular wall 118, two like side housings 112 having inwardly facing end walls 113 when joined by a plurality of bolt receiving apertures 114, and outer housing bolt receiving apertures 120 with connectors 191 passing, e.g., threaded bolts, form machine chamber 128.

FIGS. 1-9 shows two-lobe rotors 130 disposed in the machine chamber 128 which are like shaped here shown with two curved faces 132 meeting at two apexes 182 interconnecting rotor forward and rearward facing end surfaces 134*a* and 134*b* at 180 degrees. The two-lobe rotors 130 displaced for eccentric rotation, the two-lobe rotors 130 having lenticular cross sections perpendicular to axis of the eccentric rotation, wherein each of the two-lobe rotors 130 is rotatably mounted on an eccentric crank pin 138 and controlled by a rotor positioning mechanism 140, i.e, means for positioning a rotor 130, the eccentric crank pins 138 being parallel and at a crank length distance to crank shaft longitudinal axis, the rotor positioning mechanisms 140 connecting between each of the two-lobe rotors 130 to at least one stationary support, each rotor positioning mechanism 140 causing the two-lobe rotor 130 to rotate half the amount of the crank shaft 163 in the same direction or rotation, the two-lobe rotors 130 having the apexes 182 confined along a single protrusion cartiodal path and the two-lobe rotors 130 collectively have a periphery contained within a maximum envelope defined by movement of the apexes 182 of the adjacent lobe rotors 130.

Two rotor positioning mechanisms 140 are located on opposing sides of the rotor 130 rigidly aligning the crank webs 146. Opposing rotor hubs 136 extending outward from rotor side surfaces 134 are mounted by bolts 192 to crank gears 137 having eccentric crank pins 138 rotatably mounted in crank web 146 by bearings 143 in alignment with rotor axis 185, the eccentric crank pins 138 fixed laterally by bolts 193. Crank gears 137 include position orienting pin portions 141 to be received in hubs 136 having a complementary receiving surfaces 133. Pin portions 141' are similarly disposed through opening 162' to receive hubs 136'. Reversing gears 142 are rotatably mounted on laterally extending pins 145 rigidly attached to crank web 146.

A tubular central shaft 149 with a rigidly mounted central gear 152 is mounted by a set screw 156 in a receiving hole 155 inline with shaft longitudinal axis 184. The crank web 146 is rotatably mounted on central shaft 149 by bearings 150 in counter bores 148 for receiving shaft 149 and bearings 150 inline with shaft longitudinal axis 184.

Gearing mechanisms described in applicant's prior art patent, see for example, U.S. Pat. No. 7,264,452B2, can be employed which include reverse gearing mechanisms and/or alternatively use a timing belt can be employed.

Two shaft end seal cylindrical plates 160, 160' are provided. End seal cylindrical plate 160 has pin receiving members 166 extending from face 164 coaxially alignable with retaining pin receiving surfaces 147 are attached to crank web 146 by pins 168. End seal cylindrical plates 160, 160' have openings 162,162' which are coaxially aligned with crank longitudinal axis 185 for passage of rotor hubs 136, 136', respectively, and a cylindrical surface 165, 165' concentrically positioned about central shaft longitudinal axis 184 rotating within and in close proximity to side housing inwardly facing cylindrical surface 167 to form a seal. A power input or output shaft 163 extends from faces 164 along shaft longitudinal axis 184 and passes through bore 153 of central gear 152 and tubular central shaft 149.

The rotors 130 are slidably mounted between the two end walls 113 of the two side housings 112 and also between the two shaft pressure seal cylindrical plates 160 forming a seal. A biased sealing member 170 is operably disposed in a slotted retention surface 121 within central region of cartioidal protrusion of housing wall 119. It should be understood that other mechanical sealing methods can be devised to replace the biased sealing member 179 and maintain a seal for the entire cycle. This allows much larger inlet and outlet ports, and this is discussed extensively in prior art.

By way of illustration here, there is an inlet 105 and outlet 107 defined in the outer housing wall 118. Thus, as the rotors 130 move through the phases of rotation, fluid is received, compressed and expelled accordingly. The two apex of rotors 130 are positioned to move in close proximity as illustrated in FIGS. 4-8 to the outer housing portion inner annular wall 118 over a substantial part of the rotation in order to isolate separate volumes within the chamber 128. The lenticular rotors 130 have a periphery contained within a maximum envelope defined by the movement of the apexes of the opposing rotors 130. The two rotors 130 can be diametrically opposing at the same crank length, or the rotors 130 could be at different crank lengths and displaced at angles other than 180 degrees.

Figure 1:
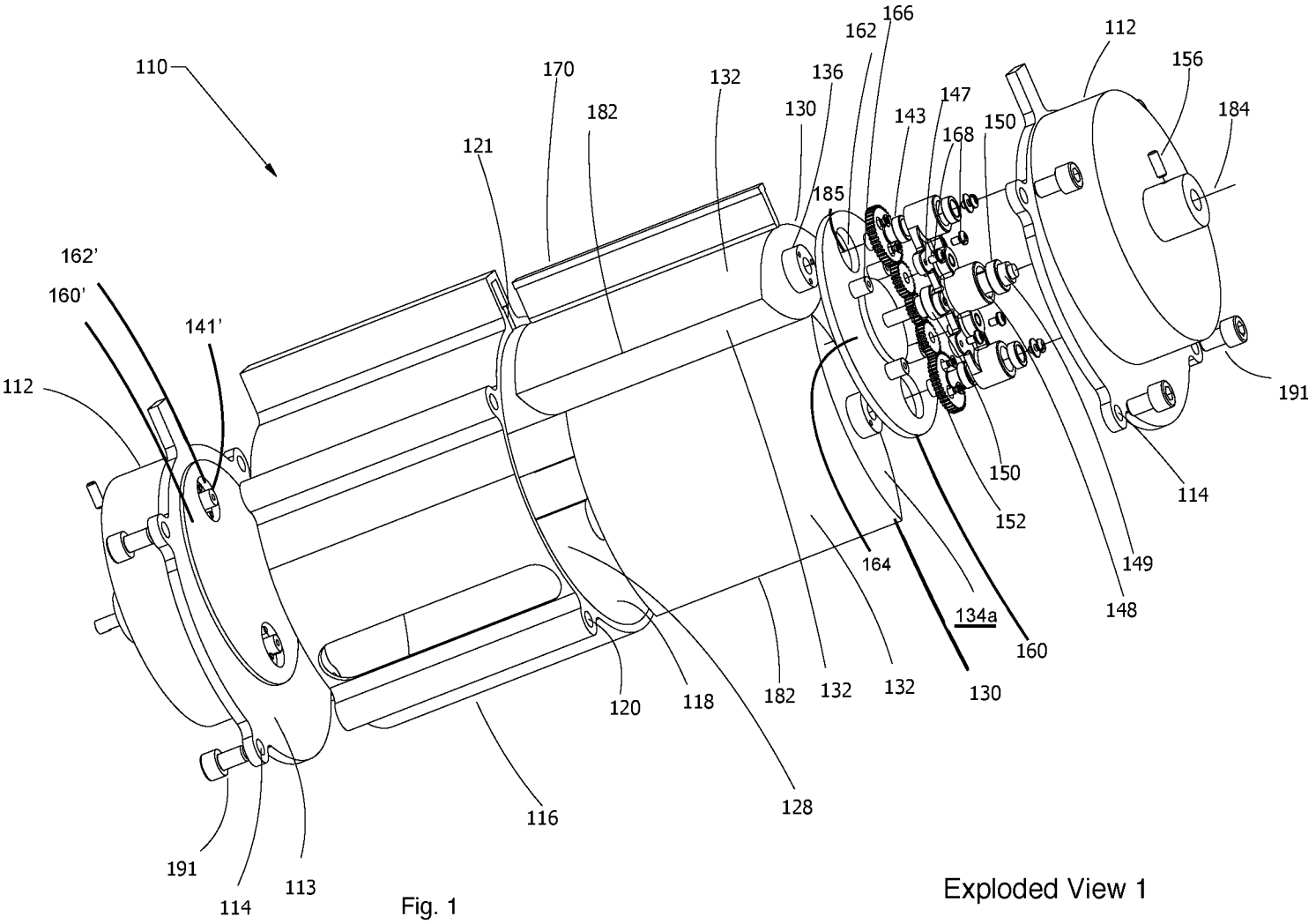
FIG. 1 is a fragmentary exploded perspective view from a first end of a first embodiment of a rotary machine according to principles of the present invention.
Figure 2:
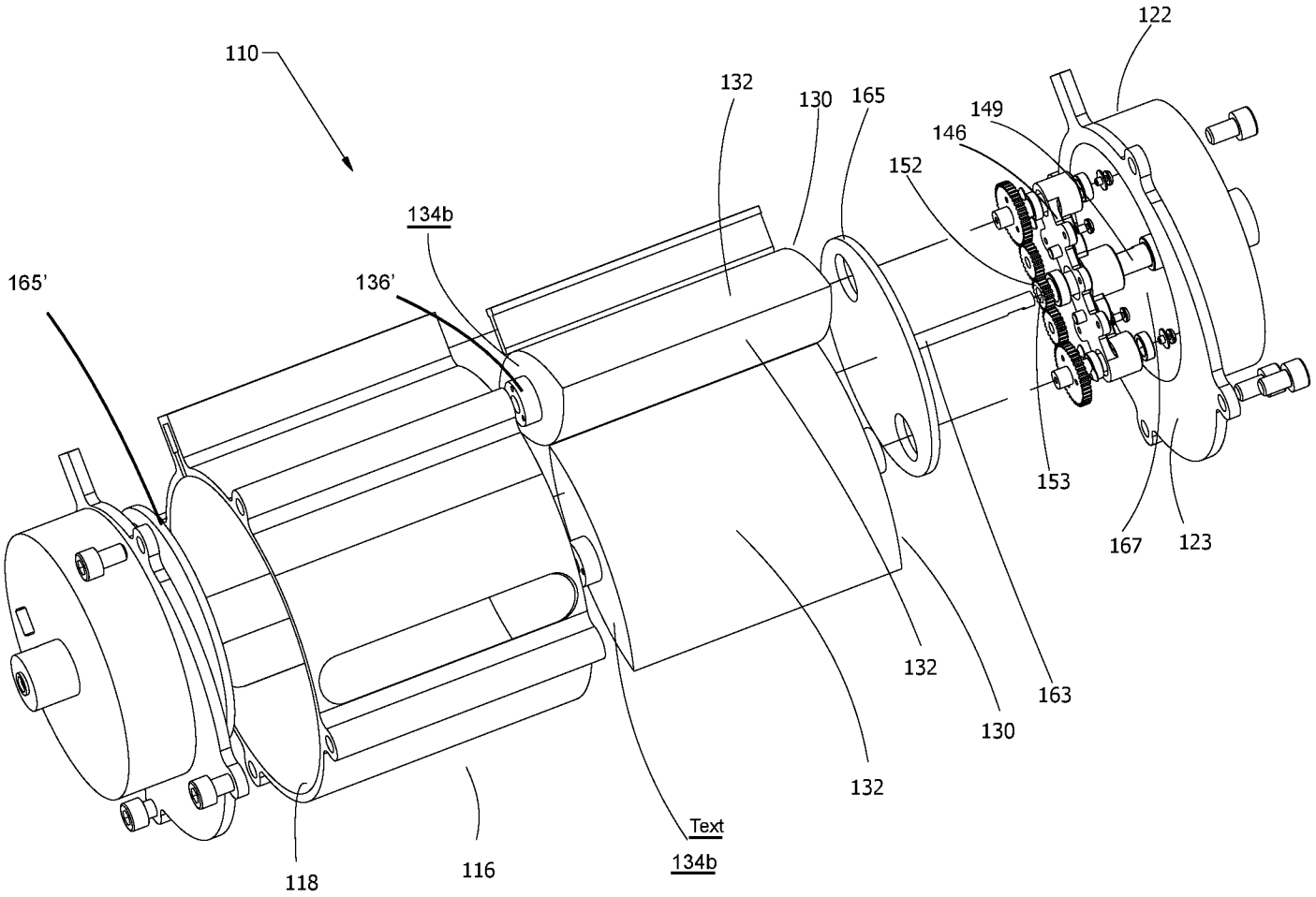
FIG. 2 is another exploded perspective view taken from another end of the first embodiment in FIG. 1.
Figure 3:
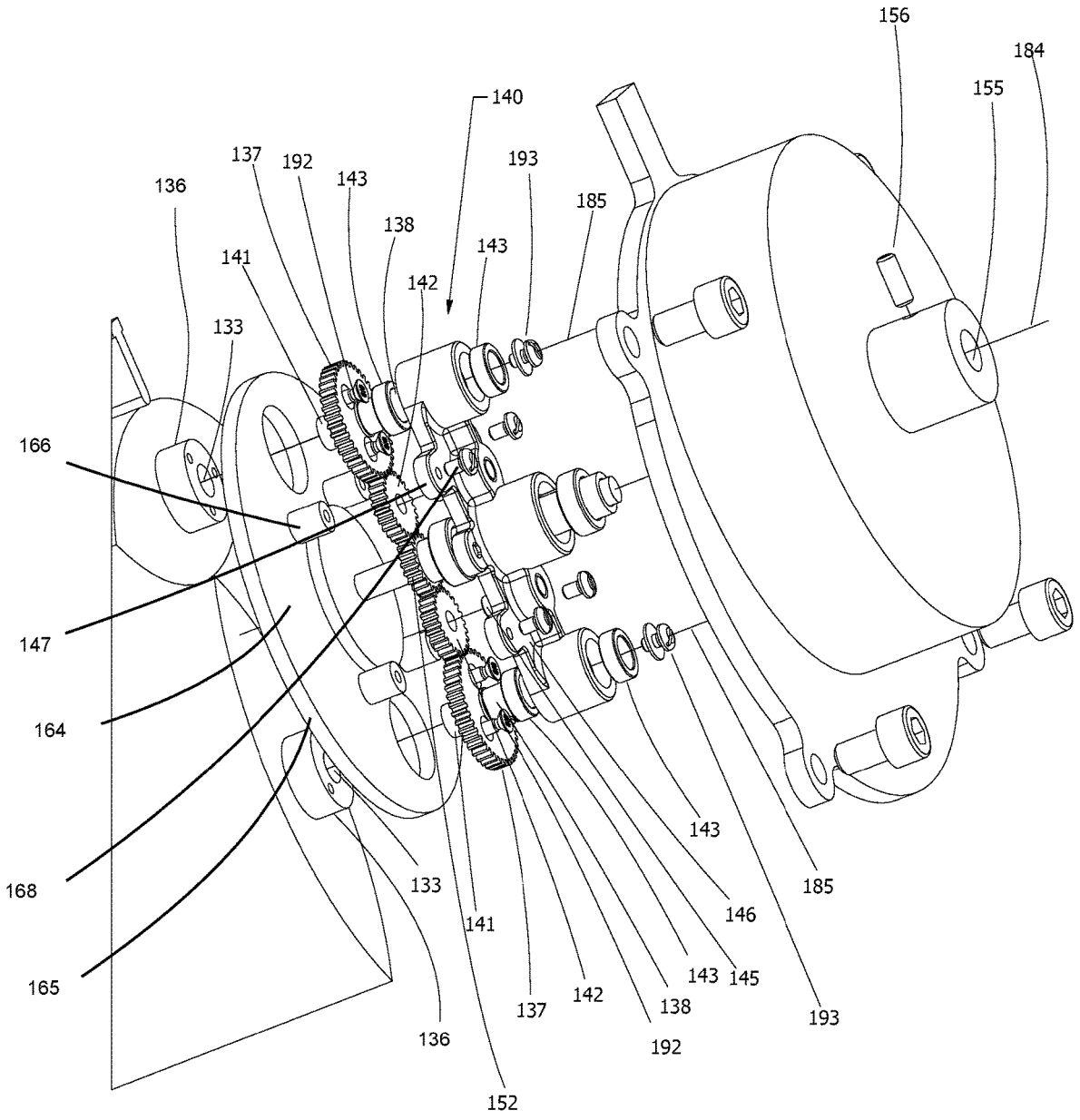
FIG. 3 is a portion of the exploded perspective view of the first embodiment in FIG. 2 view describing the rotor positioning mechanism.
Figure 4:
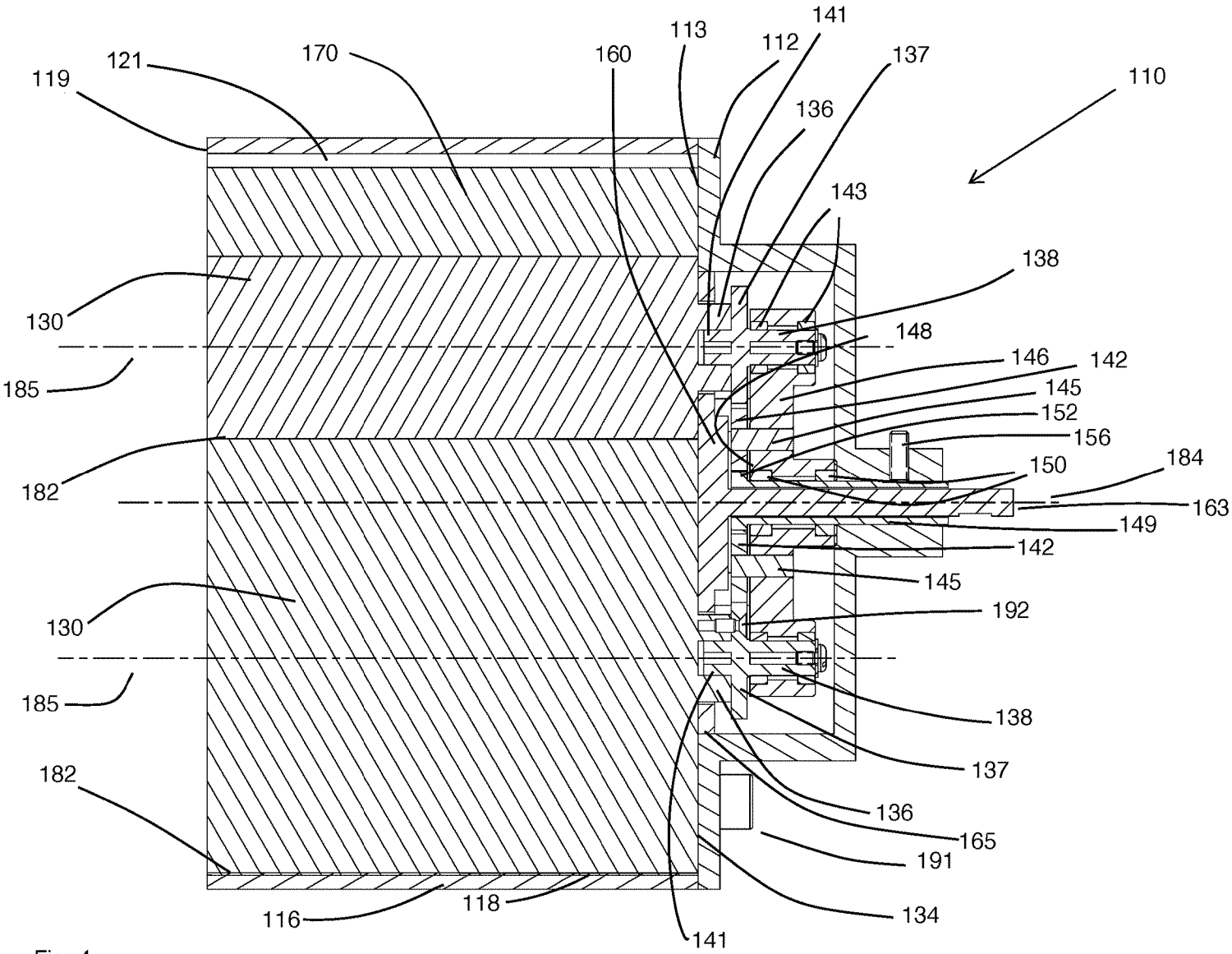
FIG. 4 is a side elevational view of the first embodiment of the rotary machine of FIG. 1.
Figure 5:
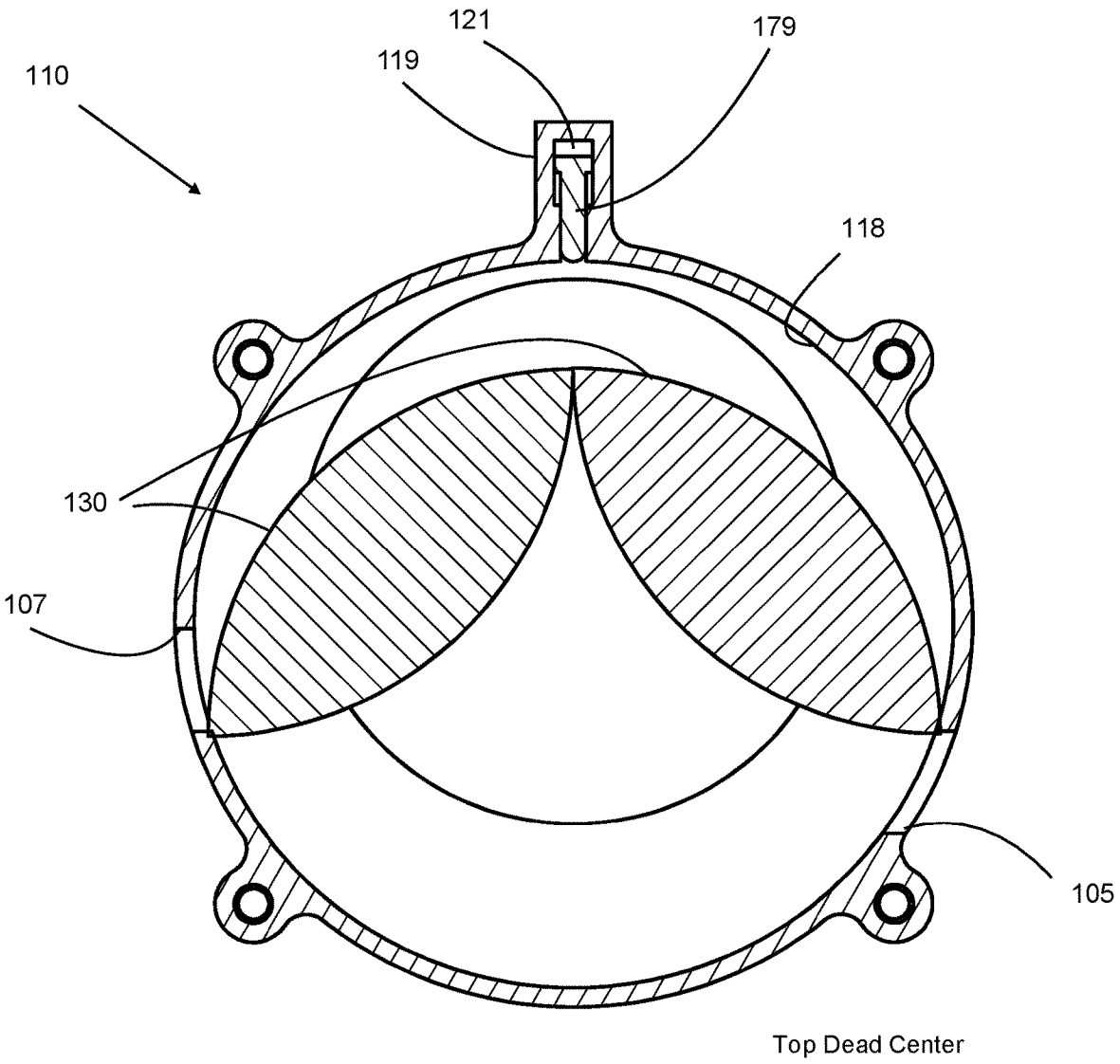
FIG. 5 is a cutaway plan end view of certain elements of the rotary machine of FIG. 1 in a first rotational phase illustrating a top dead center position.
Figure 6:
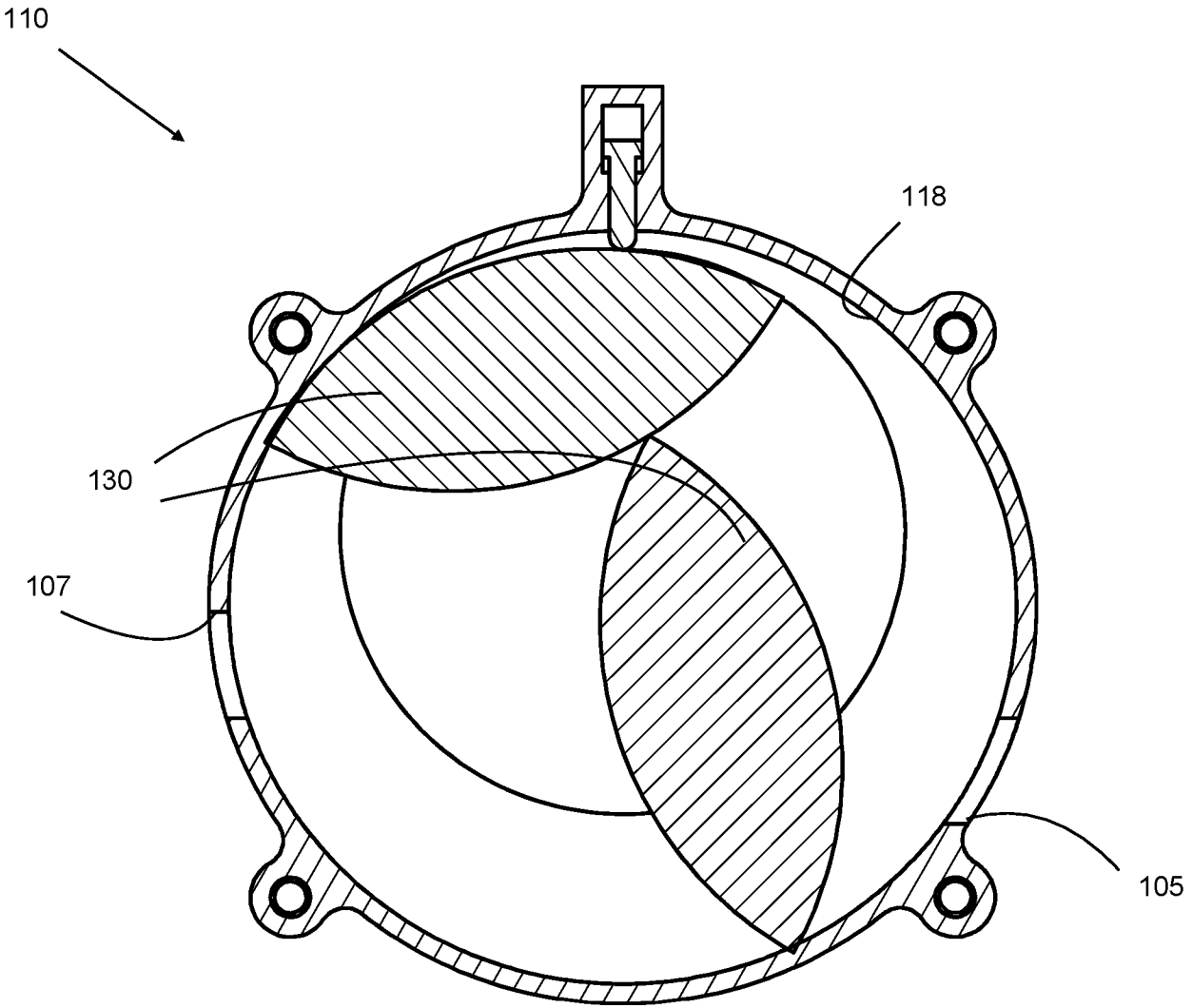
FIG. 6 is a cutaway plan end view of certain elements of the rotary machine of FIG. 1 in a second rotational phase illustrating an intake expansion phase.
Figure 7:
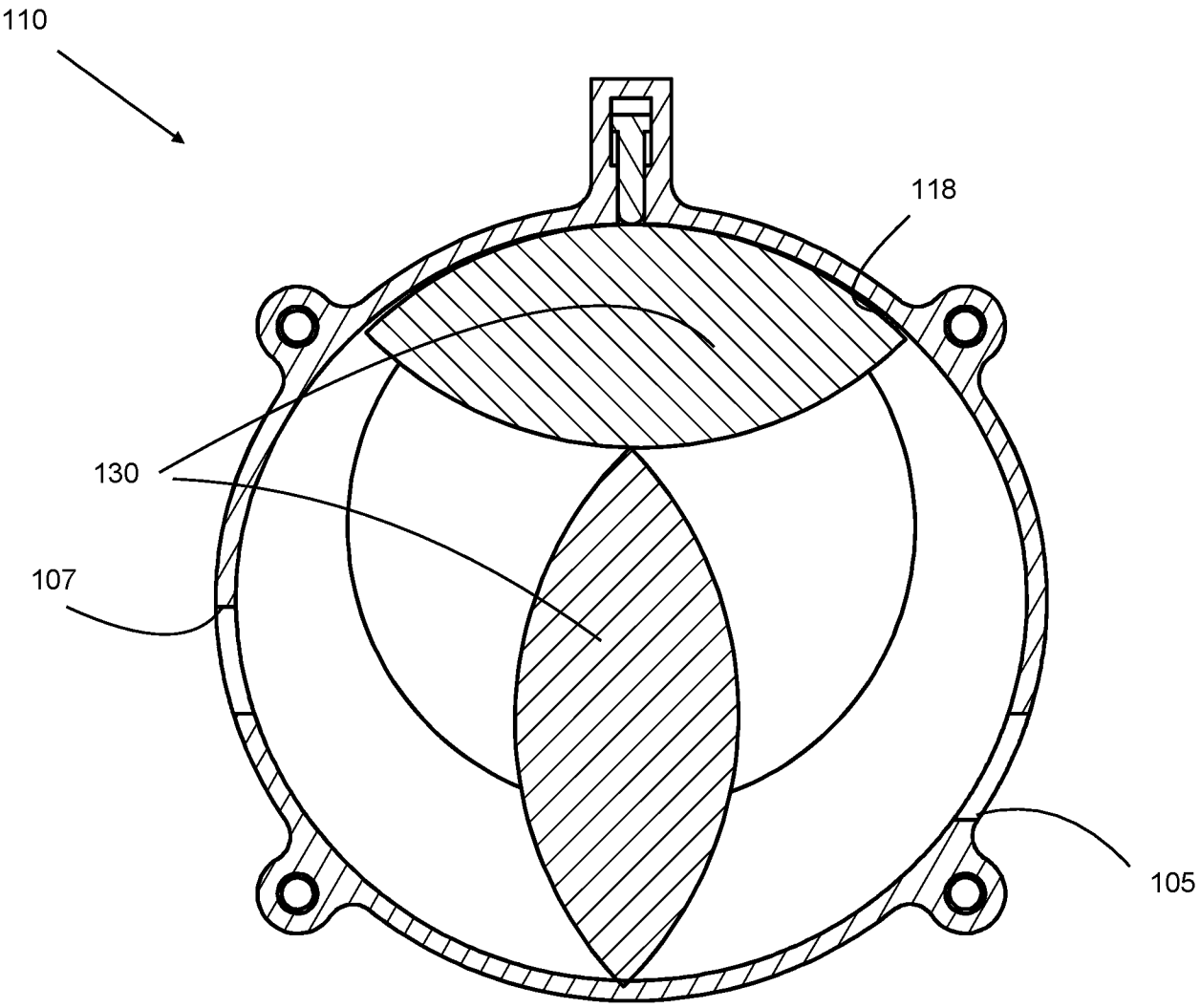
FIG. 7 is a cutaway plan end view of certain elements of the rotary machine of FIG. 1 in a third rotational phase illustrating a compression phase.
Figure 8:
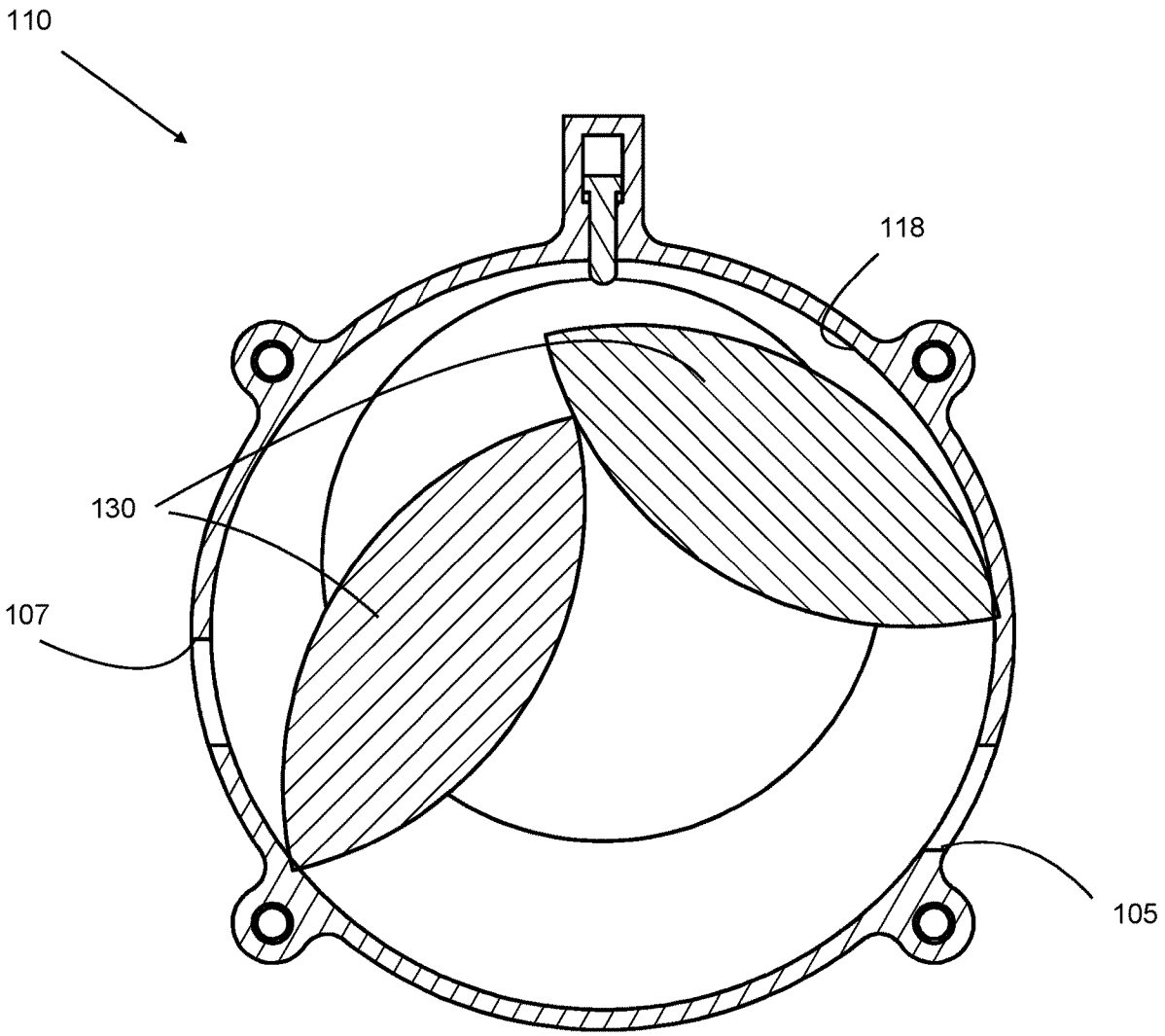
FIG. 8 is a cutaway plan end view of certain elements of the rotary machine of FIG. 1 in a fourth rotational phase illustrating a decompression/expansion phase.
Figure 9:
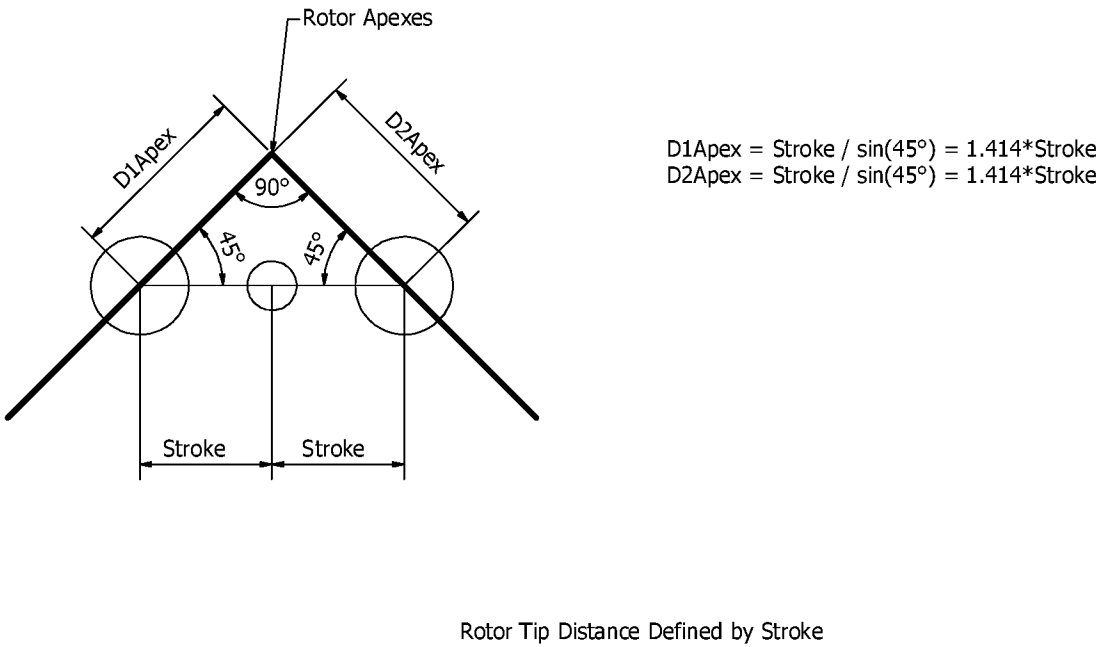
FIG. 9 is an illustration of the rotors relative apex and stroke for elements in FIG. 4.

FIG. 9 shows a line from the crank center to the rotor apex of the two rotors when both meet is at a 45 degree angle. The distance from the center of the crank to the apex, with the two crank center to rotor apex lines at a 90 degree angle, are given by the expression;

$$D2\text{Apex}=D2\text{Apex}=\text{Stroke}/\sin(45) \qquad \text{(mistake)}$$

Figure 10:
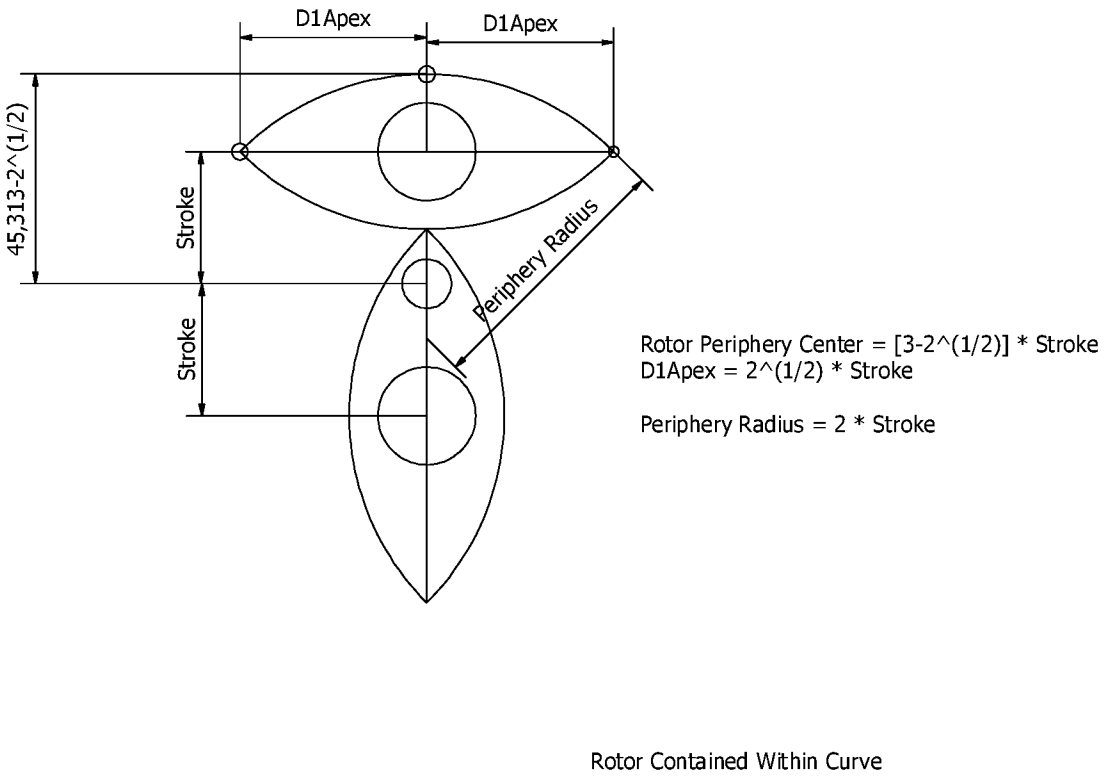

FIG. 10 shows the rotor periphery surface for which the rotor must be contained within in order not to interfere with the opposing rotor apex. The surface is an arc defined by three points which is sufficient to determine the periphery radius.

Figure 11:
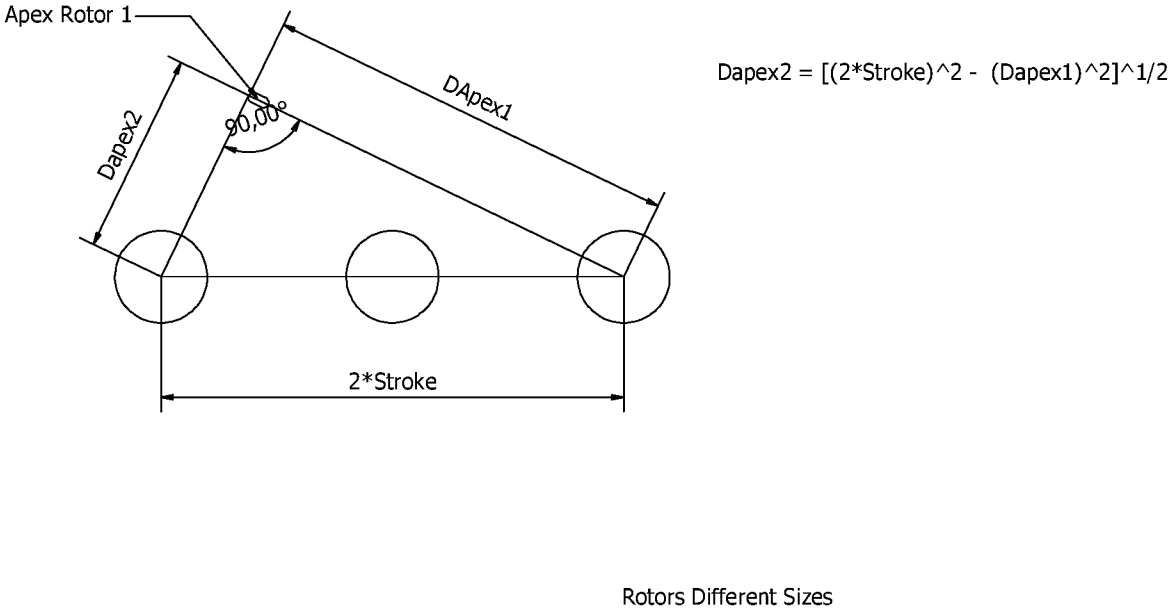
FIG. 11 is an illustration of another embodiment wherein rotors relative apex and stroke for elements are different sizes.
Figure 12:
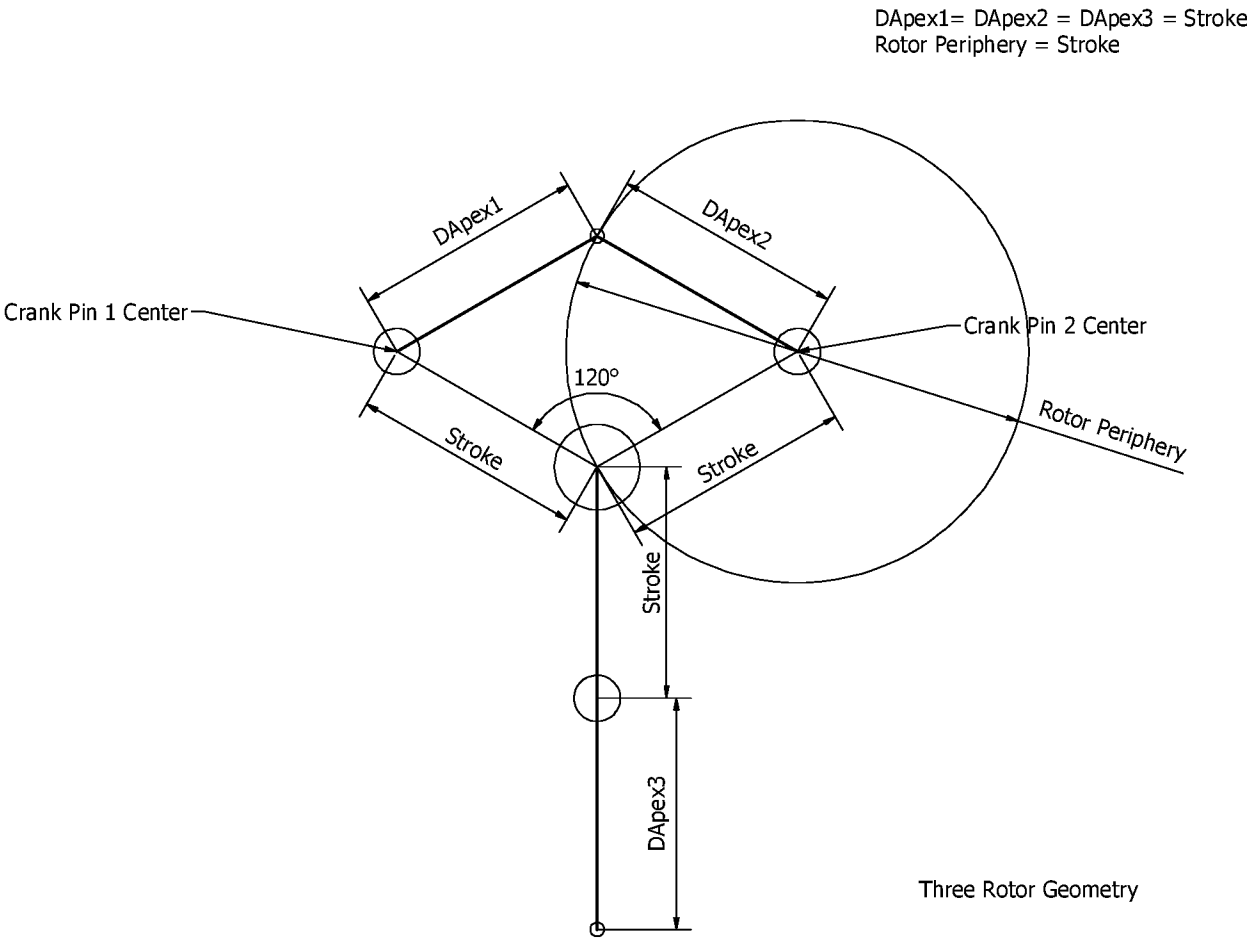
FIG. 12 is an illustration of another embodiment showing three rotor geometry wherein rotors relative apex and stroke for elements.
Figure 13:
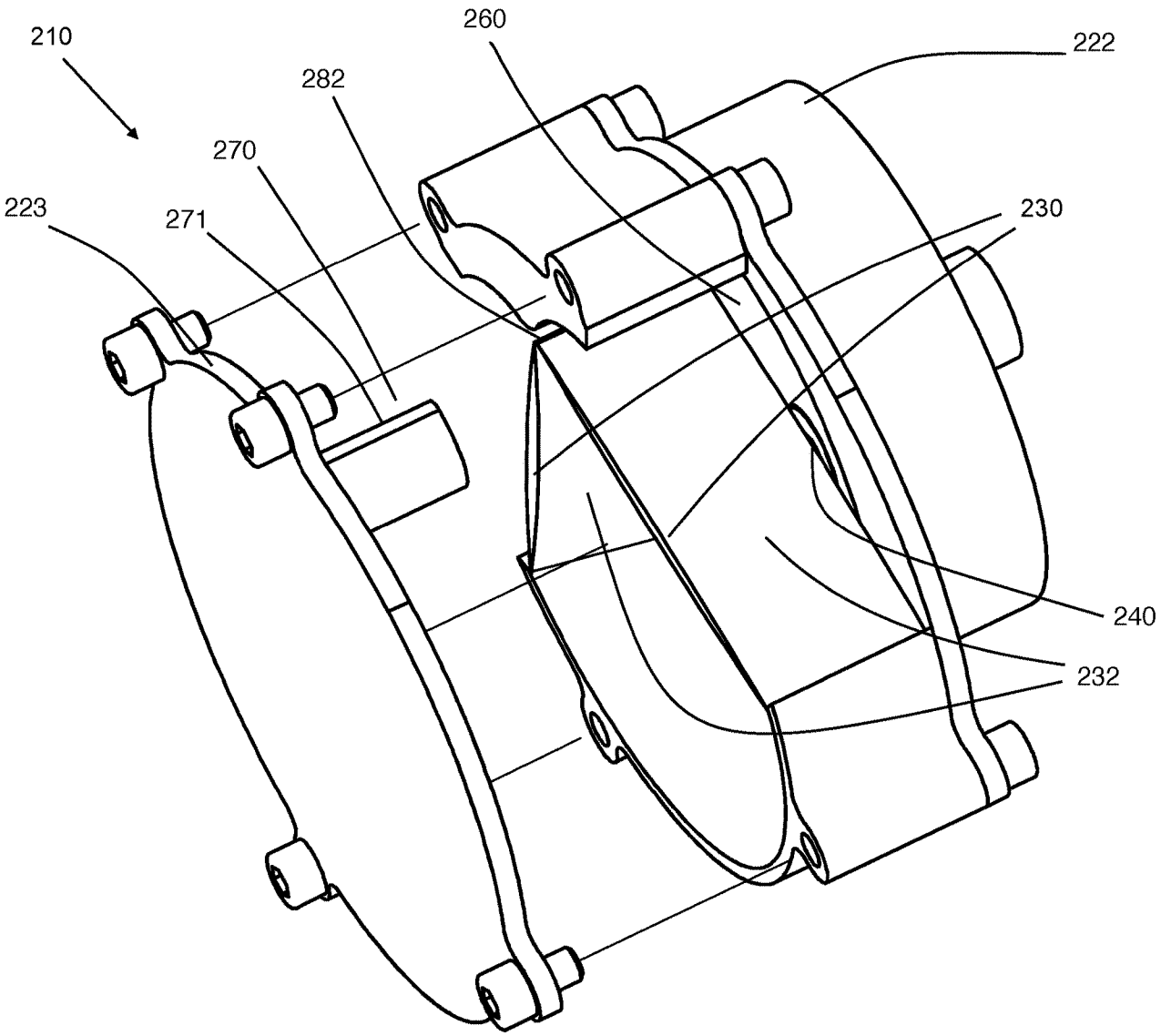
FIG. 13 is a perspective partially exploded view of a second embodiment of a rotary machine showing an internal sealing member according to principles of the present invention.
Figure 14:
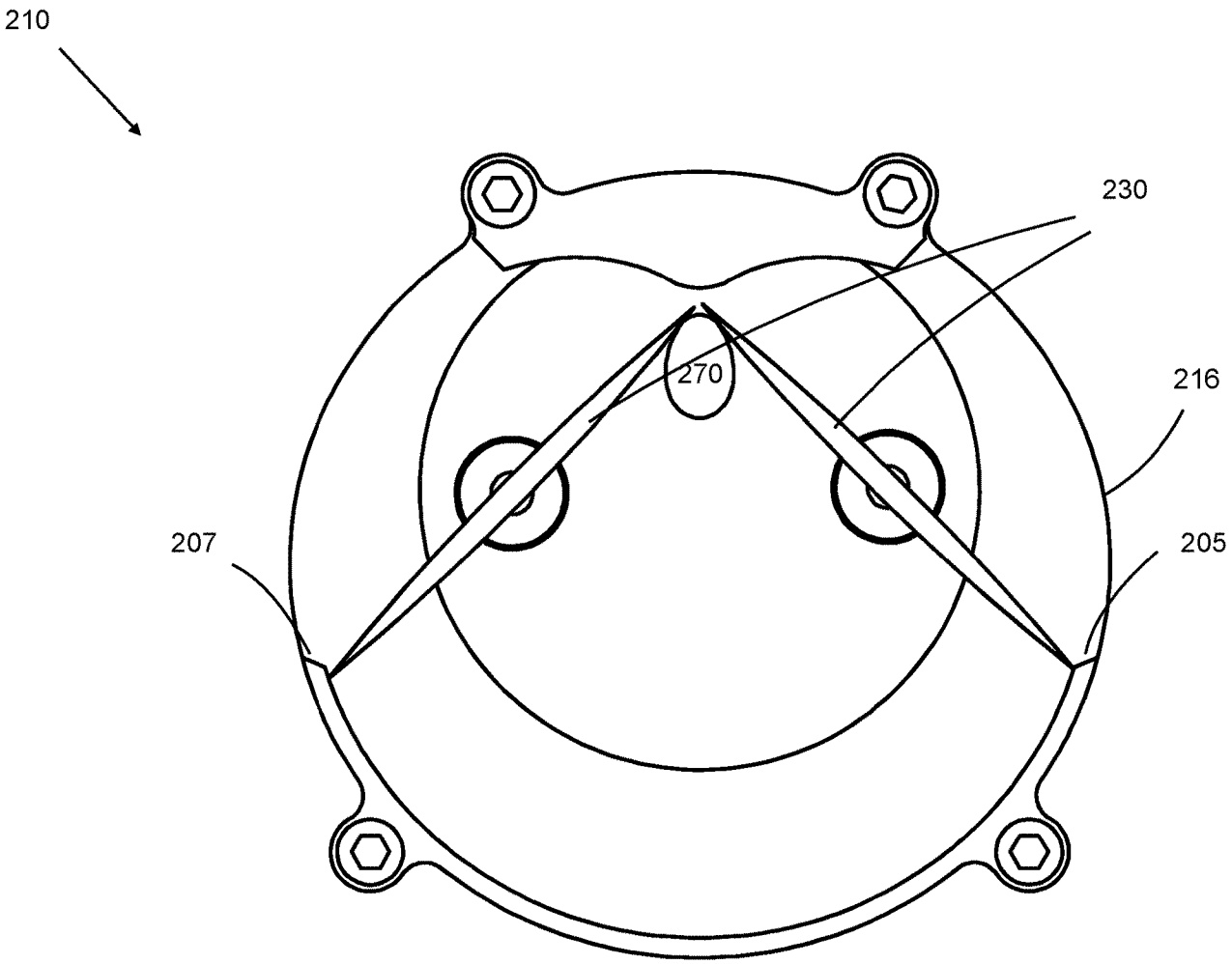
FIG. 14 is a cutaway plan end view of certain elements of the rotary machine of FIG. 13 in a first rotational phase illustrating a top dead center position.
Figure 15:
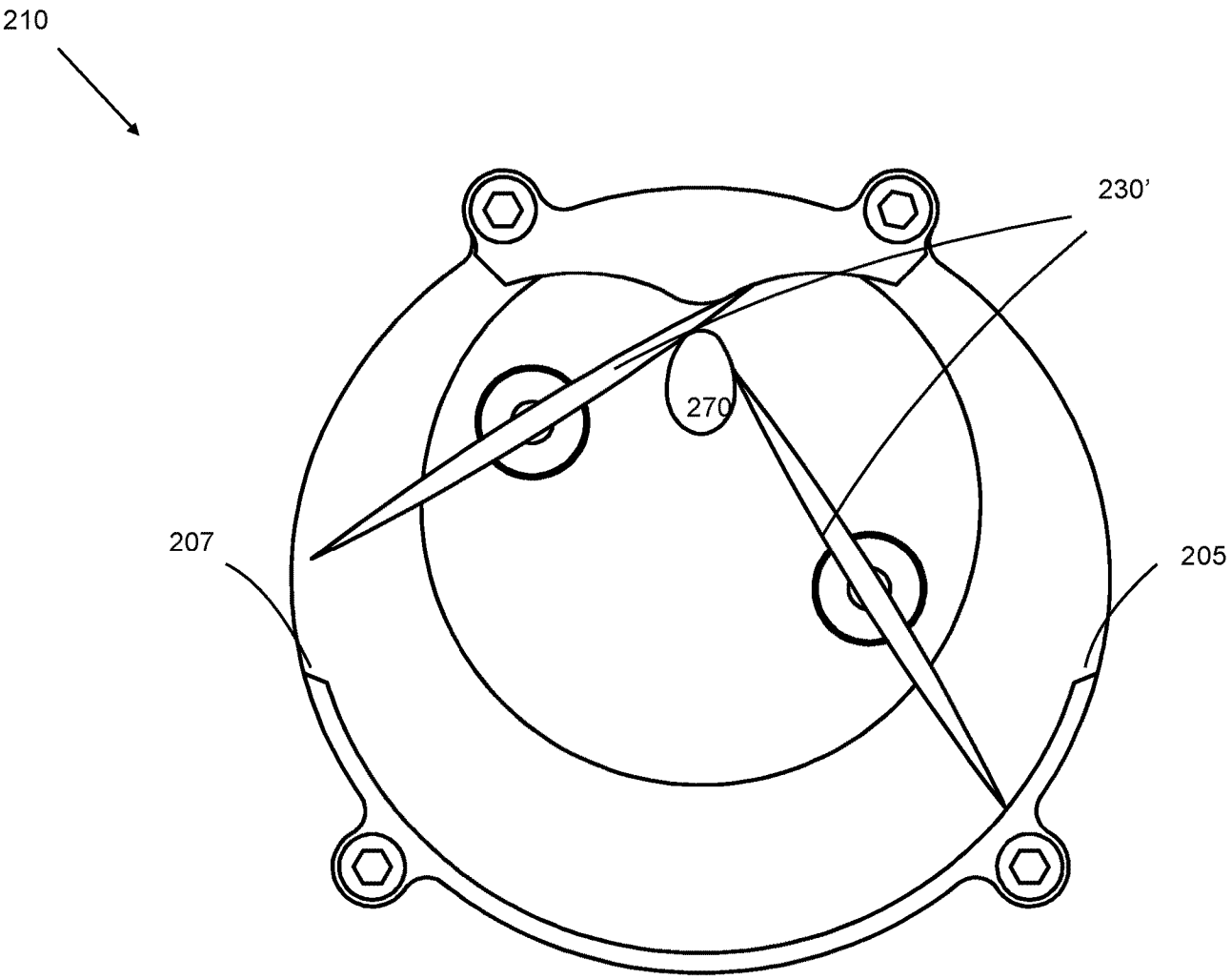
FIG. 15 is a cutaway plan end view of certain elements of the rotary machine of FIG. 13 in a second rotational phase.
Figure 16:
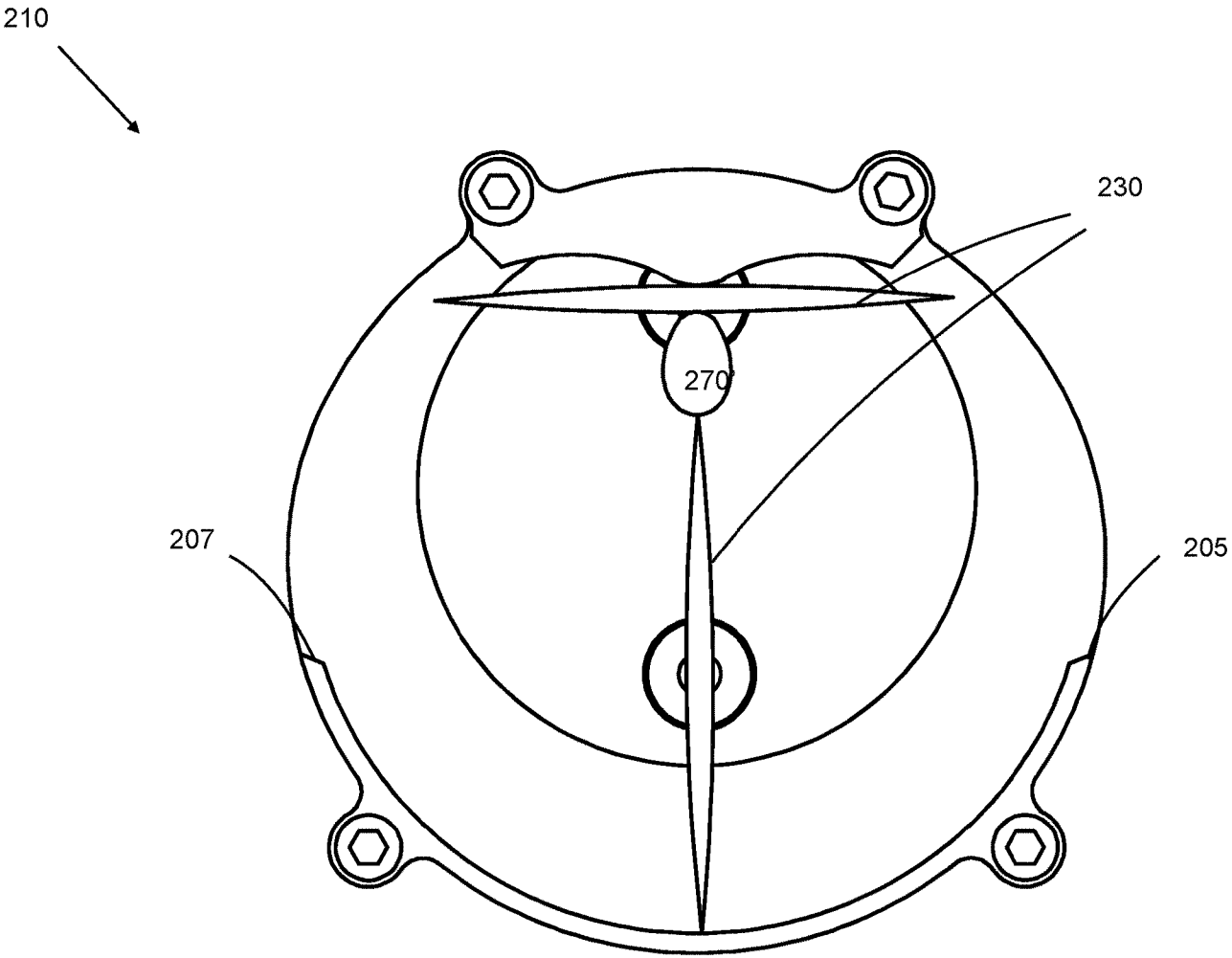
FIG. 16 is a cutaway plan end view of certain elements of the rotary machine of FIG. 13 in a third rotational phase.

The two rotors 130 may have different crank center to apex distances as shown in FIG. 11. The line between rotor centers and crank center to apex lines forms a right triangle to allow calculation of the crank center to apex distance of one if the other is known. FIG. 12 shows a three rotor design with 120 degrees between rotors. The crank center to apex distance is equal to the stroke, and the rotor periphery is circular.

FIGS. 13-16 show a second embodiment of a rotary machine 210 for the present invention with an alternative rotor design 230. Here the rotors 230 are more blade like and cooperate with a sealing member 270 protruding from a second side housing 223, said sealing member 270 having surface 271 shaped to be in close proximity with rotor surface 232 and alternatively rotor apieces 282. A rotor positioning mechanism 240 identical to rotor positioning mechanism 140 is housed within the volume provided by housing 222 and shaft side seal cylindrical plate 260. There is an inlet 205 and outlet 207 defined in the outer housing 216 shown that is much larger than inlet 105 and outlet 107.

FIG. 17 is an exploded view of a third embodiment of the present invention 310 with positioning mechanisms 340 on both sides of a rotors 330 having a sealing member 370 attached to stationary side seals 374 by bolts 376, said stationary side seals 374 attached to shafts 373 extending inward from central gears 352 attached to central shafts 349 mounted in side housings 322 on each side of the rotor 330. Central shafts 349 with rigidly mounted central gears 352 are mounted by a set screws 356 in a receiving holes 355. The input and output power is delivered by gears 377 and 378, however direct coupling can be achieved while still using the two positioning mechanisms.

FIG. 18 shows the stationary side seal 374 with attached sealing member 370. The third embodiment with two positioning mechanisms has the advantages achieved with the first embodiment of allowing the use of long rotors and maintaining alignment of crank webs by transferring torque through the rotors.

FIGS. 19 through 20 show a fourth embodiment 410 with three rotors 470 and a central seal 470 with portion removed allowing surface 471 to allow additional induction and compression with centrifugal forces similar to the radial flow turbine. The outlet duct vanes 477 are demonstrative and fluid flow design can be understood by those skilled in the art to handle high velocity flows (e.g. rotor tips near speed of sound).

It will be understood that the embodiments of the present invention assembly has been illustrated and merely exemplary and that a person skilled in the art can make variations to the shown embodiments without departing from the intended scope of the invention. All such variations, modifications and alternate embodiments are intended to be included within the scope of the present invention as defined by the claims.

What is claimed is:

1. A cartiodal rotary machine with two-lobe rotors comprising:

two two-lobe rotors having curved faces meeting at apexes, said two-lobe rotors displaced for eccentric rotation, said two-lobe rotors having lenticular cross sections perpendicular to axis of said eccentric rotation, wherein each of said two-lobe rotors is rotatably mounted on an eccentric crank pin and controlled by means for positioning said rotors, said eccentric crank pins being parallel and at a crank length distance to crank shaft longitudinal axis, said means for positioning said rotors connecting between each of said two-lobe rotors to at least one stationary support, said means for positioning said rotors causing said two-lobe rotors to rotate half the amount of the crank shaft in the same direction or rotation, said two-lobe rotors having said apexes confined along a single protrusion cartiodal path and said two-lobe rotors collectively have a periphery contained within a maximum envelope defined by movement of the apexes of said nearest adjacent lenticular rotor.

2. The cartiodal rotary machine with two-lobe rotors of claim 1, wherein said two-lobe rotors are contained within a chamber having an inner annular wall, end seal plates, and outer annular wall, said inner annular wall in region of cartiodal protrusion, said apexes and said curved faces move in close proximity to said inner annular wall, said two-lobe rotors having forward and rearward facing end surfaces which move in close proximity to said end seal plates, and said two-lobe rotors apexes and said curved faces move in close proximity to said outer annular wall, which collectively form a seal, said seal forming a working volume, said working volume comprising a chamber, said chamber having intake and outlet ports in communication with said working volume cooperating to provide a positive displacement action as said two-lobe rotors are moved within said chamber, said positive displacement action using one of a crank shaft input to provide pumping action and pressure of a working medium to provide crank shaft output.

3. The cartiodal rotary machine with two-lobe rotors of claim 2, wherein said two-lobe rotors are displaced at an angle of 180 degrees around said crank shaft longitudinal axis.

4. The cartiodal rotary machine with two-lobe rotors of claim 2, wherein said lenticular rotors are displaced at same said crank length.

5. A cartiodal rotary machine with two-lobe rotors comprising:

at least three two-lobe rotors having curved faces meeting at apexes, said two-lobe rotors displaced for eccentric rotation, said two-lobe rotors having lenticular cross sections perpendicular to axis of said eccentric rotation, wherein each of said two-lobe rotors is rotatably mounted on an eccentric crank pin and controlled by means for positioning said rotors, said eccentric crank pins being parallel and at a crank length distance to crank shaft longitudinal axis, said means for positioning said rotors connecting between each of said two-lobe rotors to at least one stationary support, said means for positioning said rotors causing said two-lobe rotor to rotate half the amount of the crank shaft in the same direction or rotation, said two-lobe rotors having said apexes confined along a single protrusion cartiodal path and said two-lobe rotors collectively have a periphery contained within a maximum envelope defined by movement of the apexes of said nearest adjacent lenticular rotor.

6. The cartiodal rotary machine with two-lobe rotors of claim 5, wherein said two-lobe rotors are contained within a chamber having an inner annular wall, end seal plates, and outer annular wall, said inner annular wall in region of cartiodal protrusion, said apexes and said curved faces move in close proximity to said inner annular wall, said two-lobe rotors having forward and rearward facing end surfaces which move in close proximity to said end seal plates, and said two-lobe rotors apexes and curved faces move in close proximity to said outer annular wall, which collectively form a seal, said seal forming a working volume, said working volume comprising a chamber, said chamber having intake and outlet ports in communication with said working volume cooperating to provide a positive displacement action as said two-lobe rotors are moved within said chamber, said positive displacement action using one of a crank shaft input to provide pumping action and a pressure of a working medium to provide crank shaft output.

7. The cartiodal rotary machine with two-lobe rotors of claim 6, wherein said two-lobe rotors are displaced around said crank shaft longitudinal axis at an angle of 360 degrees di-vided by the number of said two-lobe rotors.

8. The cartiodal rotary machine with two-lobe rotors of claim 7, wherein said lenticular rotors are displaced at same said crank length.

* * * * *